US009512601B2

(12) United States Patent
Bronstein

(10) Patent No.: US 9,512,601 B2
(45) **Date of Patent: *Dec. 6, 2016**

(54) REMOTE CONTROLLED SHOWERING APPARATUS AND RELATED METHODS

(71) Applicant: Edgar Lehrer Bronstein, Caracas (VE)

(72) Inventor: Edgar Lehrer Bronstein, Caracas (VE)

( * ) Notice: Subject to any disclaimer, the term of this patent is extended or adjusted under 35 U.S.C. 154(b) by 697 days.

This patent is subject to a terminal disclaimer.

(21) Appl. No.: 13/745,921

(22) Filed: Jan. 21, 2013

(65) Prior Publication Data

US 2014/0201903 A1 Jul. 24, 2014

Related U.S. Application Data

(63) Continuation-in-part of application No. 13/472,612, filed on May 16, 2012, now Pat. No. 8,978,175, which is a continuation-in-part of application No. 12/895,214, filed on Sep. 30, 2010, now abandoned, which is a continuation-in-part of application No. 12/827,721, filed on Jun. 30, 2010, now abandoned, which is a continuation-in-part of application No. 12/725,138, filed on Mar. 16, 2010, now Pat. No. 8,347,425.

(51) Int. Cl.
*A47K 3/00* (2006.01)
*E03C 1/06* (2006.01)

(52) U.S. Cl.
CPC ..... *E03C 1/066* (2013.01); *E03C 1/063* (2013.01); *Y10T 29/49716* (2015.01)

(58) Field of Classification Search
CPC ..... E03C 1/066
USPC ..... 4/559, 567, 568, 597, 606, 612, 614, 4/615; 239/587.1, 752
See application file for complete search history.

(56) References Cited

U.S. PATENT DOCUMENTS

| | | | | | |
|---|---|---|---|---|---|
| 1,982,509 | A * | 11/1934 | Frank | A61M 35/00 | 128/897 |
| 4,142,257 | A * | 3/1979 | Mace | A47K 3/287 | 4/615 |
| 4,171,094 | A * | 10/1979 | Halfen | E03C 1/063 | 239/282 |
| 4,339,833 | A * | 7/1982 | Mandell | 4/541.6 | |
| 4,561,136 | A | 12/1985 | Baer | | |
| 4,651,720 | A * | 3/1987 | Baus | E03C 1/06 | 4/614 |
| 6,286,764 | B1 * | 9/2001 | Garvey et al. | 236/12.12 | |
| 6,443,164 | B1 * | 9/2002 | Parker | A61H 35/00 | 119/671 |
| 7,889,187 | B2 * | 2/2011 | Freier | G05D 23/1393 | 251/129.01 |
| 8,545,461 | B2 * | 10/2013 | Thomason | A61M 35/00 | 4/600 |
| 8,978,175 | B2 * | 3/2015 | Bronstein | 4/601 | |
| 2003/0167565 | A1 * | 9/2003 | Yoshida | 4/606 | |
| 2005/0039252 | A1 | 2/2005 | Fainberg | | |
| 2005/0172396 | A1 | 8/2005 | Marrs et al. | | |

(Continued)

FOREIGN PATENT DOCUMENTS

JP 3195523 8/1991

*Primary Examiner* — Paul R Durand
*Assistant Examiner* — Nicholas Ros
(74) *Attorney, Agent, or Firm* — Allen Dyer Doppelt Milbrath & Gilchrist

(57) ABSTRACT

The invention is directed to a remote controlled shower assembly having an electronically controlled shower head that is controlled by a computerized control unit as well as related methods of installation and use. The assembly can automatically bathe a user by following a program that dictates time of bathing, shower head position and motion, and the dispensing of bathing agents such as body wash or shampoo.

9 Claims, 4 Drawing Sheets

(56) References Cited

U.S. PATENT DOCUMENTS

2007/0186340 A1* 8/2007 Gay ..... A61M 35/00 4/597
2011/0155880 A1* 6/2011 Stimpson ..... 248/285.1
2011/0225724 A1* 9/2011 Bronstein ..... 4/614

* cited by examiner

REMOTE CONTROLLED SHOWERING APPARATUS AND RELATED METHODS

CROSS-REFERENCE TO RELATED APPLICATIONS

This is a Continuation-in-Part application of U.S. application Ser. No. 13/472,612 filed May 16, 2012 entitled "Variable Position Shower Apparatus and Related Methods," which is a Continuation-in-Part application of U.S. application Ser. No. 12/895,214 filed Sep. 30, 2010 entitled "Vertical Positioning Shower Attachment," which is a Continuation-in-Part Application of U.S. application Ser. No. 12/827,721 filed Jun. 30, 2010 entitled "Self-Cleansing Automated Shower Attachment," which is a Continuation in Part application of U.S. application Ser. No. 12/725,138 filed Mar. 16, 2010, now U.S. Pat. No. 8,347,425 issued on Jan. 8, 2013, entitled "Shower Attachment and Related Method of Use," the disclosures of which are herein incorporated by reference in their entirety.

FIELD OF THE INVENTION

This invention is directed to a remote controlled shower attachment attachable to an existing shower enclosure for purposes of vertically positioning a shower head about a user to deliver, through automation, water and cleansing agents and related methods of installation and use.

BACKGROUND OF THE INVENTION

The traditional showering apparatus primarily comprises a shower head and valves for regulating both the temperature and flow of the water through the shower head. Most advances in the field of showering relate to shower head designs that vary flow and spray settings to create various spray pulsations and patterns, often for the purpose of effectuating a massage. Other advances have included placement of multiple shower head arrays to create an envelope or cascade of water around a user. These additional shower heads are placed along the shower enclosure wall or on the ceiling of the shower. Many of these advances have focused, however, on the same fundamental shower system of a shower head and regulating valves.

Of course, showering remains a fundamental regimen for good personal hygiene. This is especially true in hospitals, nursing homes, and assisted living facilities wherein cleanliness helps to prevent the spread of bacteria and viruses. It is often the case that individuals being treated at these facilities have infirmities that prevent them from showering without assistance. However, assistance when showering is not only potentially uncomfortable and embarrassing for the infirm individual, but requires a significant level of time and patience on the part of the assisting professional.

Very little has been done to create automated shower systems to assist infirm individuals who cannot stand upright to take a shower. Moreover, it is desirable to design a system to deliver a cleanser such as soap, shower gel, or similar agents.

Such systems could be employed to effectuate luxury and spa-like showering experiences. Current domestic shower systems optionally include a hand wand that is attached to the water regulating valves. A flexible tube attaches the hand wand to water-regulating valves so that the user has greater freedom to provide direct water pressure to various parts of the user's body. Optionally, these hand wands include settings to allow changes in pressure and water pattern. By engaging the hand wand, water is diverted from the shower head (typically located above the wand) and thus allows for a more spa-like feel.

Accordingly, there is a need in the art for a robust shower system designed to adapt to existing shower systems to allow infirm individuals to shower without need of assistance. Moreover, such an attachment should provide a complete shower to those infirm individuals with limited motor skills. Optionally, such attachment allows delivery, through automation, of cleaning agents to the infirm individual. In addition, there is a need in the art for domestic shower systems that provide automated and adjustable attachments for a spa like massage without the need for a manually operated wand. Preferably, such a device can be interchangeably used for both domestic and assisted living facilities in order to be mass-produced in a cost effective manner.

SUMMARY OF THE INVENTION

In view of the foregoing background, it is therefore an object of the present invention to provide an automated showering apparatus. The apparatus comprises a shower head, the position of which can be vertically adjusted by a motor. The motor changes the position of the shower head. The position of the shower head is constrained by a substantially rigid guide that defines a motion path of the shower head. A control unit having a microprocessor and memory is in communication with the motor for the purpose of controlling the position of the shower head along the motion path. A power supply supplies power to both the processing unit and the motor. An electronic receiver is in communication with the control unit and receives signals from a remote control. The remote control issues commands to control the position of the shower head which are communicated to and received by the receiver. The remote control is wireless or, alternatively, wired to the receiver.

The invention also contemplates a method of showering comprising the steps of pre-programming a program into the shower assembly's control unit microprocessor, for the purpose of the program controlling the motion path of the shower head. This program is saved in the shower assembly's memory. The program is initiated so that the shower head follows the pre-programmed motion path. A remote control is also provided for controlling the shower assembly.

A method of bathing another individual in a shower is also contemplated by the invention. The steps for this method include providing a shower stall for an individual and turning on a water source so that a stream of water flows from a shower head. The stream of water is directed onto the individual, and a remote control is used to wirelessly alter the position of the shower head so that position of the stream of water changes relative to the individual.

For a conventional shower to provide such functionality, the method of converting such a shower to an automated shower is also contemplated by the invention. The steps of this method comprise removing a shower head from a water supply line and attaching an automated shower assembly, as described herein, to a surface proximate the shower head. This automated shower assembly is attached to the water supply line and a source of electricity is connected to the shower assembly of electricity.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

In the Summary of the Invention above and in the Detailed Description of the Invention and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally. The term "comprises" is used herein to mean that other elements, steps, etc. are optionally present.

In this section, the present invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The Overall Apparatus

Figure 1:
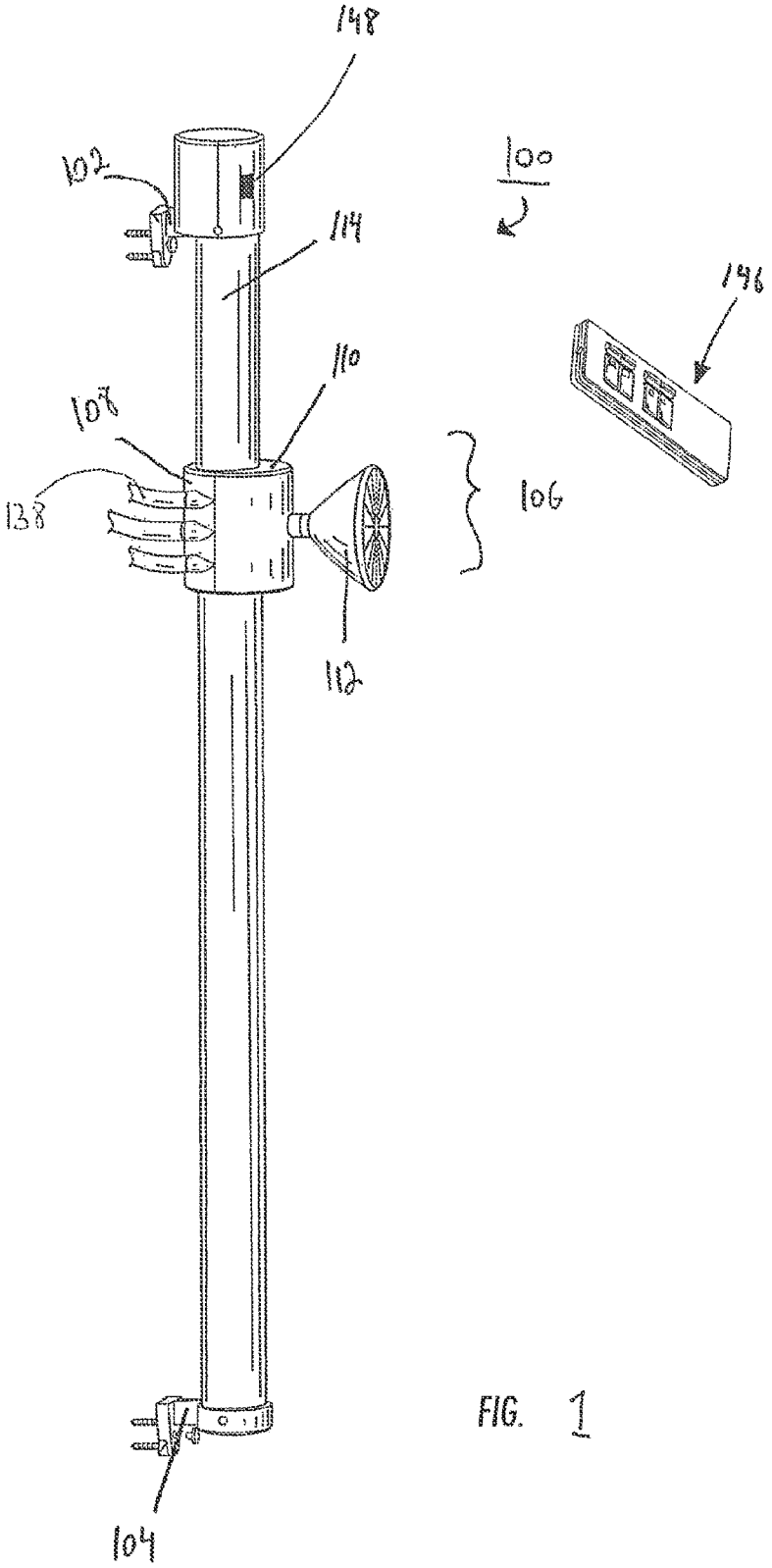
FIG. 1 is a perspective view of one embodiment of the invention.

Referring initially to FIG. 1, the overall apparatus taught by the invention relates to a shower attachment 100 which can be installed in an existing shower enclosure. In one contemplated use, the shower attachment 100 is used within a residence to aid in providing a total body cleansing. Such application can offer a spa-like experience by enveloping a user with a variety of angled jet sprays. In addition, the apparatus can alternatively be used to ensure proper cleansing of a child or other individual with sub-optimal motor function.

In a second contemplated use, the shower attachment 100 is used in a medical facility such as a hospital, nursing home, or assisted care facility to allow the elderly or infirm to shower in privacy, providing a reduced need for assistance and supervision by medical professionals. Such an application additionally decreases the spread of disease within such facilities, as it increases the ease and frequency of patient bathing. Other applications of the shower attachment 100 shall be known and understood by those of ordinary skill in the art upon review of the figures and disclosure contained herein.

Figure 2:
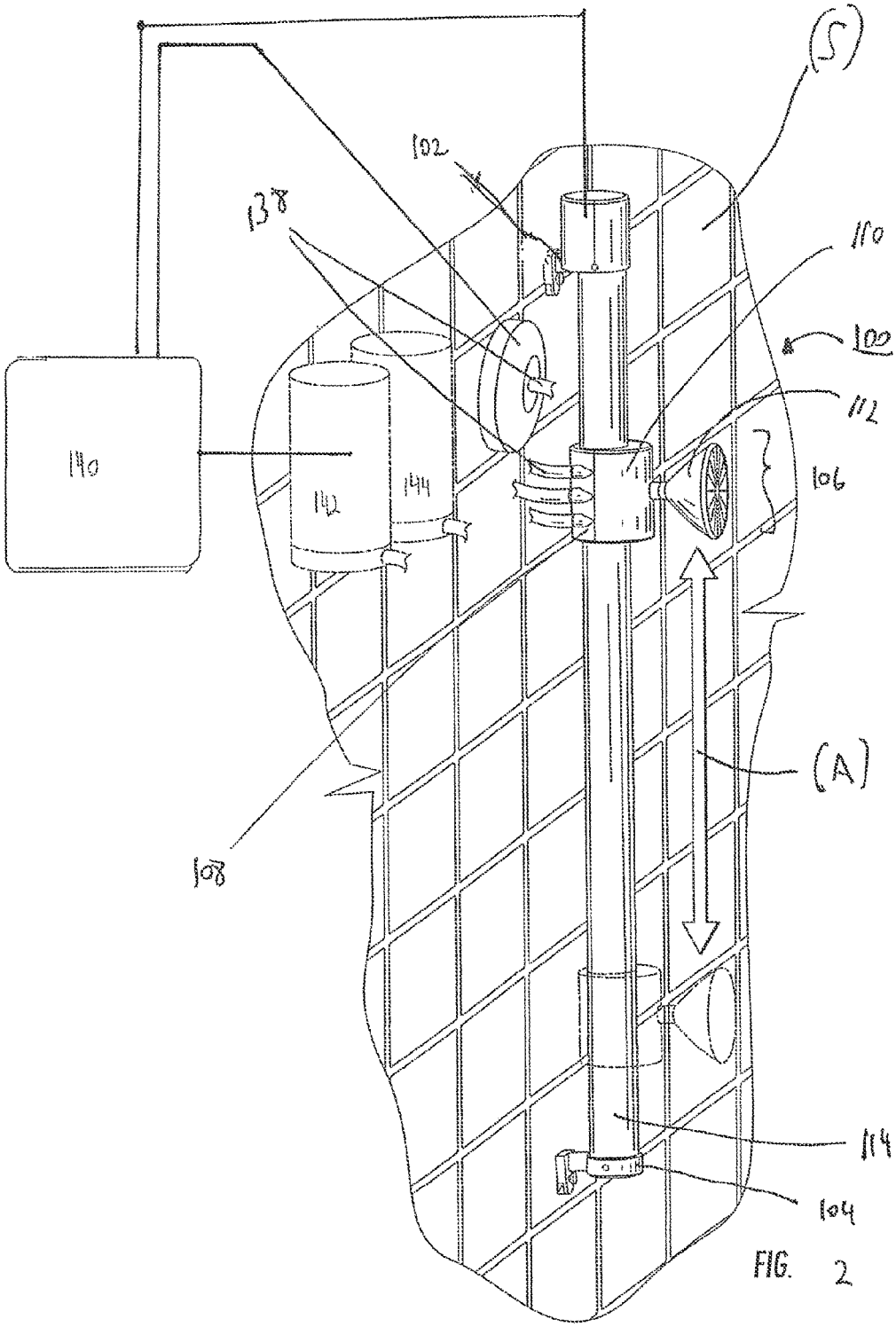
FIG. 2 is a perspective view of a like embodiment as illustrated in FIG. 1, that is installed on a substantially vertical surface.

FIG. 1 offers, by way of example a preferred embodiment of the shower attachment 100. The primary external components of the shower attachment 100, as illustrated, are a first plate 102 for the purpose of mounting the shower attachment to a mounting surface (S) (As illustrated in FIG. 2), a second plate 104 for the purpose of mounting the shower attachment to the mounting surface (S), a trolley 106 comprising at least a first portion of the trolley 108, a second portion of the trolley 110, and a shower head 112. A guide rod housing 114 communicates with at least one of the first plate 102 and the second plate 104. The guide rod housing 114 conceals the internal components (described in detail below) of the shower attachment 100 for safety and aesthetic purposes as well as for the purpose of protecting the internal components from the elements. The trolley 106 is a moveable unit that moves about the guide rod housing 114 to position the shower head 112 for bathing purposes.

The Actuation Mechanism

FIG. 2 illustrates the shower attachment 100 installed on a mounting surface (S). As illustrated by an arrow (A) in FIG. 2, the trolley 106 moves positions between the first plate 102 and the second plate 104.

Figure 3:
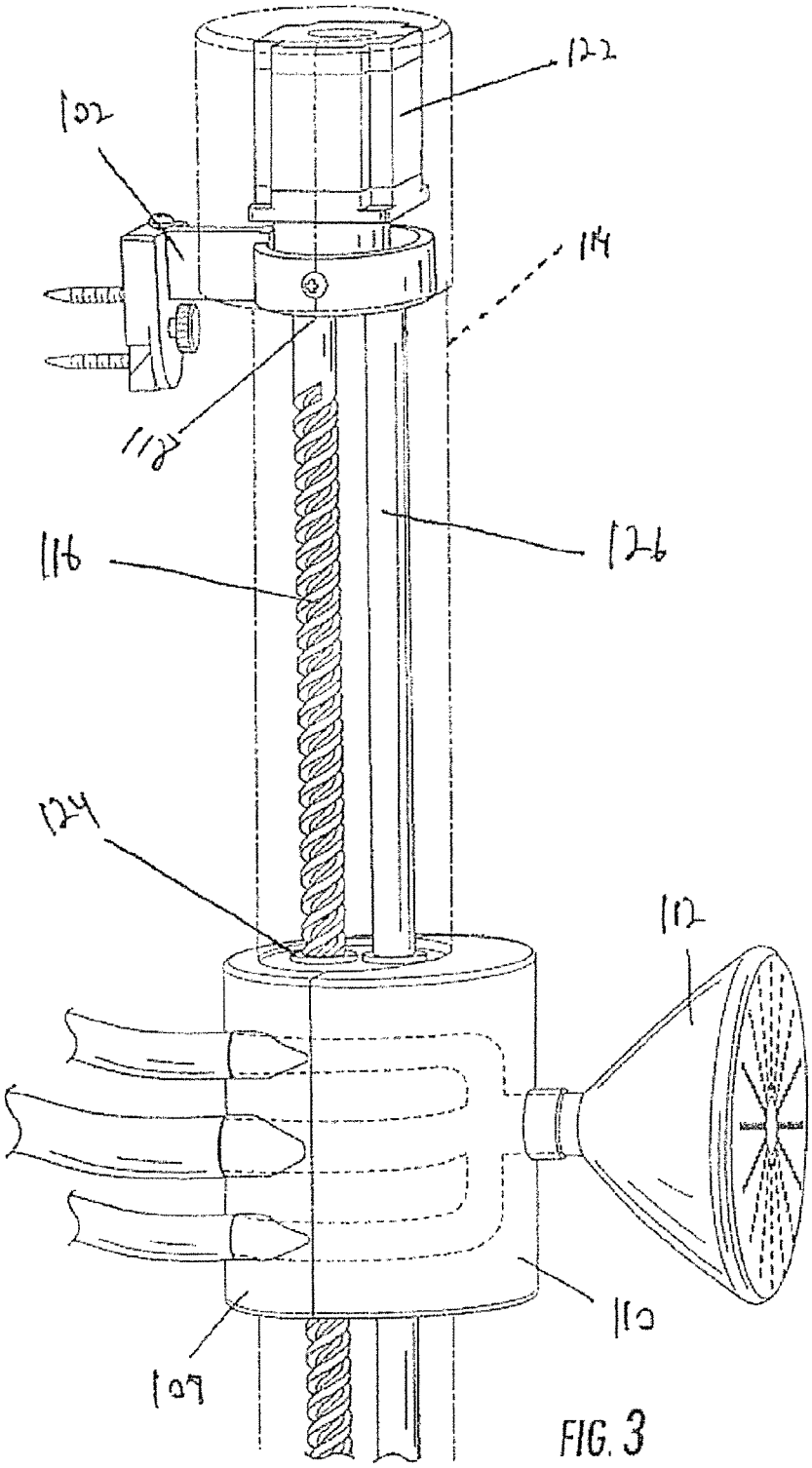
FIG. 3 is a cutaway perspective view of one embodiment of the invention.

FIG. 3 reveals some of the internal components of the trolley responsible for the motion of the trolley 106. A leadscrew 116 having a first end 118 and a second end 120 (FIG. 4) is in communication with the first plate 102 and the second plate 104. The leadscrew 116 rotates about its long axis. The leadscrew 116 is made of a metal, and comprises one of square threads, acme threads, buttress threads, or a helical bearing raceway. In a preferred embodiment the leadscrew is stainless steel 116 or any other non-corrosive material.

With continuing reference to FIG. 3, a motor 122 engages the first end 118 of the leadscrew 116 so that the motor 122 causes the leadscrew 116 to rotate. The motor 122 is one of an AC motor, brushed DC motor, brushless DC motor, printed armature DC motor, switched reluctance motor, or servo motor. In a preferred embodiment, the motor 122 is a stepping motor. The hazard of electrocution is circumvented by way of the motor being connected to a transformer which will break the electrical connection in the event the electrical components come in contact with water.

The motor 122 also fixedly engages the first plate 102. At least one nut 124 engages the leadscrew 116, the nut 124 having threads that are complimentary to the leadscrew 116 threads. The nut 124 also communicates with at least one guide rod 126. We have found that multiple guide rods reduce noise and "chatter." The guide rod 126 is a smooth rod having a first end and a second end (FIG. 4), the first end engaging the first plate 102, and the second end engaging the second plate 104. The guide rod 126 is rigidly secured by the first and second plates 102, 104 using at least one of a mechanical fastener, pressure fit, thread, and adhesive. As the leadscrew 116 rotates, the nut 124 travels along the long access of the lead screw, effectively converting the rotational forces of the leadscrew 116 into a linear motion. The communication with the guide rod 126 prevents the nut 124 from merely spinning in place and also provides the nut 124 with a physical guide to follow so to create a linear motion path. Reversing the rotation of the leadscrew 116 reverses the direction of nut 124 travel.

The Trolley

Figure 4:
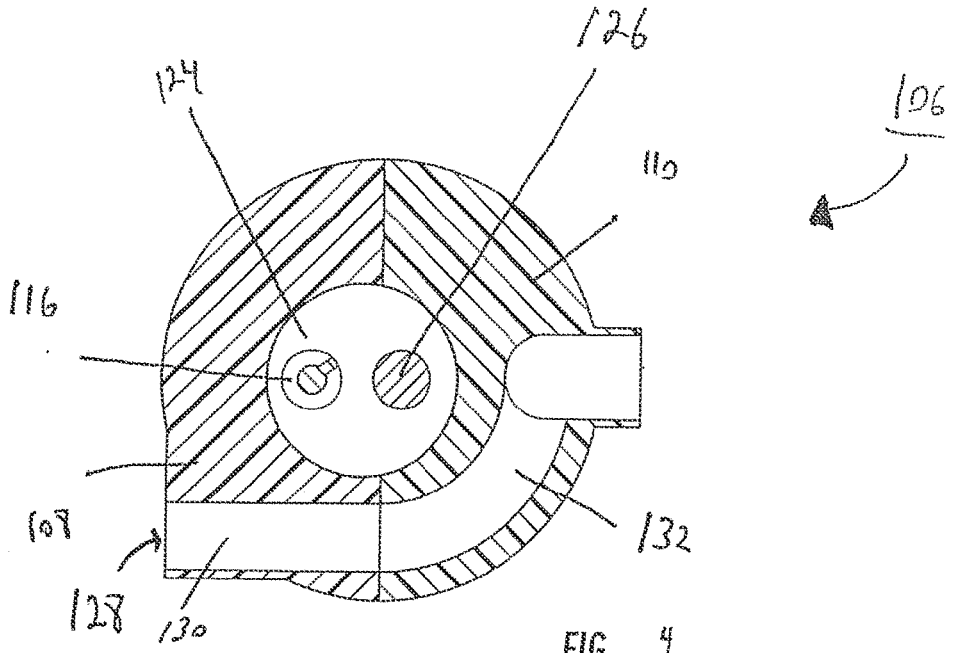
FIG. 4 is a top cutaway view of the trolley.

Referring now to FIG. 4, in a preferred embodiment the trolley 106 is of a multi-part construction. The first portion of the trolley 108 is affixed to the second portion of the trolley 110, and both portions 108, 110 fixedly engage the nut 124 that is in communication with the lead screw 116. As the nut 124 travels as a result of the leadscrew 116 turning, the attached trolley 106 travels with the nut 124.

Figure 5:
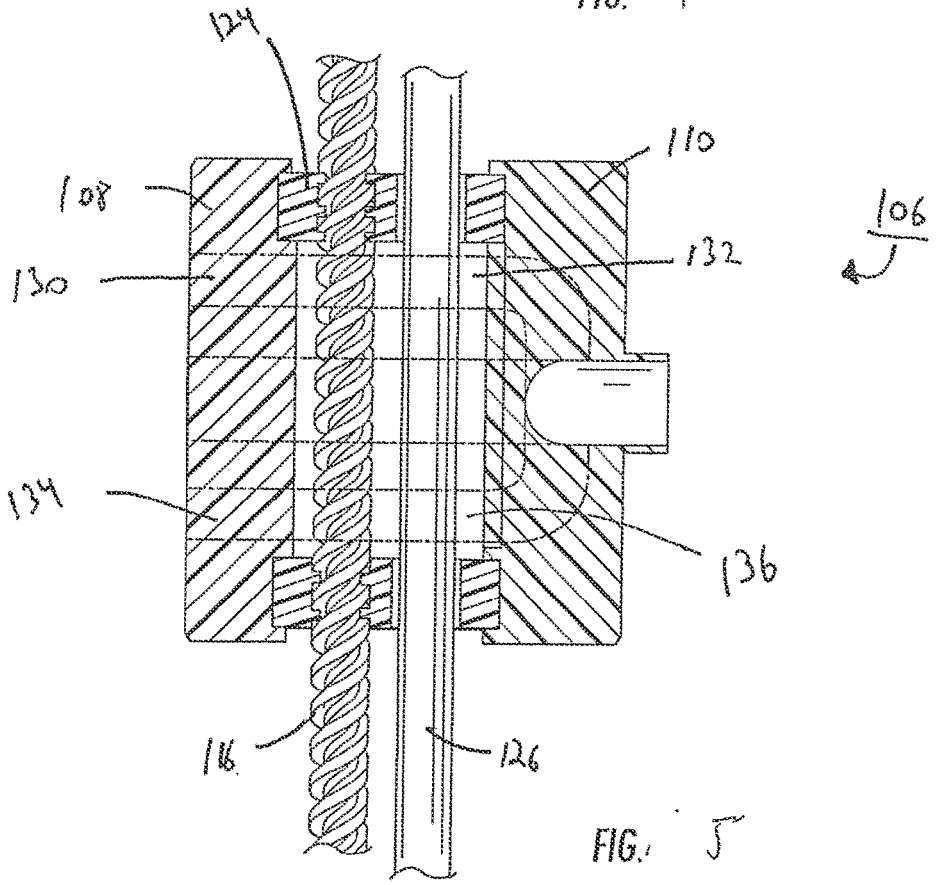
FIG. 5 is a side cutaway view of the trolley.

FIGS. 4 and 5 illustrate a first opening 128 of the first internal conduit 130 of the first portion of the trolley 108, wherein water introduced into the water supply line travels through the first internal conduit 130 of the first portion of the trolley 108 into a second internal conduit 132 of the second portion of the trolley 110 and exits through the shower head 112. The first internal conduit 130 meets the second internal conduit 132 at a first conduit junction 131.

FIG. 5 illustrates additional conduits of the trolley 106 that communicate with the shower head 112. A third internal conduit 134 of the first portion of the trolley 108 communicates with a fourth internal conduit 136 of the second portion of the trolley 110. The third internal conduit 134 meets the fourth internal conduit 136 at a second conduit junction (not shown). In one embodiment the trolley 106 comprises enough conduit routes to the shower head to deliver water, shampoo, body wash, conditioner, and any other solutions for known for use in bathing. In another embodiment, the third and fourth conduits 134, 136 serve to deliver shampoo, body wash, conditioner, and any other solutions for known for use in bathing. Solution reservoirs 142, 144 containing bathing solution communicate with the third and fourth conduits 134, 136.

With reference to FIG. 2, a water supply line 138 is sealedly connected to the first opening 128 of the first internal conduit 130 of the first portion of the trolley 108, wherein water introduced into the water supply line 138 travels through the first portion of the trolley 108 and second portion of the trolley 110 and exits through the shower head 112.

The trolley 106 is attached to the nut 124, so that when the leadscrew 116 turns, causing the nut to travel in a linear motion path, the trolley 106 moves along the same path, thus the shower head 112 can spray water or cleansing solutions at various height levels.

With reference again to FIG. 2, the motor 122 is electronically controlled, and in an embodiment communicates with a processor/microcontroller 140 (control unit). The processor/microcontroller 140 communicates with sensors and actuators for the purpose of controlling the trolley 106 height, the pressure and temperature of water leaving the shower head 112, the cleansing solution composition, and the sequence and timing of these apparatus features. In particular, sensors to detect trolley position, trolley travel limits, water temperature, water flow, and solution reservoir 142, 144 levels are connected to the processor/microcontroller 140. Based on sensor input and user input, the processor/microcontroller 140 operates the motor 122, cleansing solution reservoir pumps, and water line valves and solenoids. Thus, cleaning routines may be programmed by a user or from the factory that wet, clean, and rinse a user automatically.

In one embodiment of the invention, a remote control 146 electronically communicates with the processor/microcontroller 140. The processor/microcontroller 140 receives signals from the remote control 146 through a receiver 148. The remote control 146 sends a wireless signal to the receiver 148 and processor/microcontroller 140 using at least one of infrared, radio frequency, and Bluetooth as a communications means. The remote control 146 is the interface used to control and program the shower attachment 100. For example, a patient could be given a "hands off" shower by a nurse since the nurse controls the shower position, water flow, water temperature, cleansing agent dispensing, and duration of shower using a remote control. Additionally, a user can program a cleansing routine to have pre-defined motion paths, overall bathe time, rinse times, water pressures, water temperatures, and timing of cleansing solution dispensing events so that a user can simply initiate a pre-programmed shower routine with a single touch of a button.

In yet another embodiment, a wired controller electronically communicates with the processor/microcontroller 140. The processor/microcontroller 140 receives signals from the controller via a wired connection. In such embodiments, the wired controller may be the interface used to control and program the shower attachment 100. However, it would be contemplated that both a wired controller and a remote control 146 may be in communication with the processor/microcontroller 140 and either means could be utilized to control and program the shower attachment 100. Also, either of the wired controller or remote control can be installed on a wall or any surface where the control can be utilized.

Method of Use

The invention contemplates a method of use of the shower attachment 100 that comprises pre-programming a program into the shower assembly's processor/microcontroller 140. The program controls the trolley's 110 motion path by adjusting the rate and rotational direction of the leadscrew 116, which controls the speed, direction, and position of the trolley 110 and therefore shower head 112. The program is saved in the shower attachment's 110 memory. The program may be inputted into the processor/microcontroller 140 using the remote control 146 as the input means. Additionally, the program is initiated with a remote control so that the shower head 112 follows the programmed steps, including pre-programmed motion paths. Therefore, a user may pre-program the shower attachment 100 with a series of defined showering steps to take, and then later execute the program using the remote control 146. Alternatively, the shower attachment 100 can be supplied to the user with pre-programmed shower routines, so a user need not program the shower attachment 100, but the user can still execute such programs with the remote control 146.

Method of Installation

The invention also contemplates a method of installation of the shower attachment 100. The method involves converting a conventional shower stall or bathtub having a shower attachment to an automated shower. The method comprises the steps of removing the pre-installed shower head from the buildings water supply line to expose a source of water for the shower assembly, if necessary. The shower attachment 100, as described herein is installed on a surface proximate the shower head so that the water supply line is attached to the shower attachment 100. The shower attachment 100 is connected to a source of electricity.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A shower assembly, comprising:

a shower head;

means for positioning the shower head including:

at least one substantially rigid guide rod having a first and second end, the guide rod engaging the shower head and defining a motion path upon which the shower head travels;

a leadscrew having a first end and a second end;

a first plate upon which the first end of the leadscrew is rotatably joined and upon which the first end of the guide rod is attached;

a second plate upon which the second end of the lead is rotatably joined and upon which the second end of the guide rod is attached;

a nut having threads complimentary to the leadscrew that engages the leadscrew to translate a rotary motion of the lead screw into a linear motion of the nut, wherein the nut simultaneously engages the guide rod to prevent the nut from rotating about the leadscrew, wherein the nut travels along the length of the guide rod when the leadscrew rotates; and a trolley attached to the nut, wherein the shower head is attached to the trolley;

a motor in communication with the shower head positioning means, wherein the motor provides the force necessary to change the position of the shower head; and a control unit having a microprocessor, the control unit being in communication with the motor for the purpose of controlling the position of the shower head along the motion path upon which the shower head travels;

a memory device in communication with the control unit;

a power supply to supply power to the control unit and the motor;

an electronic receiver in communication with the control unit for receiving a signal from a remote control; and a remote control for issuing control commands to control the position of the shower head, the commands communicated to and received by the electronic receiver.

2. The shower assembly of claim 1, wherein the remote control wirelessly communicates with the electronic receiver.

3. The shower assembly of claim 1, wherein the remote control communicates with the electronic receiver through a wired connection.

4. The shower assembly of claim 1, wherein the processor is programmed to automatically drive the leadscrew as part of a pre-programmed shower head travel sequence.

5. The shower assembly of claim 1, further comprising a cleansing solution reservoir in communication with the shower head, wherein the control unit controls the dispensing of a cleansing solution within the reservoir to without the shower head.

6. The shower assembly of claim 5, wherein the processor is programmed to automatically release the cleaning solution as part of a pre-programmed sequence of user-chosen events.

7. A method of showering using the shower assembly of claim 1, the method comprising the steps of:

pre-programming a program into the shower assembly's control unit microprocessor, the program controlling the shower head motion path;

saving the program to the shower assembly's memory;

providing the remote control for controlling the shower assembly; and initiating the program so that the shower head follows the pre-programmed motion path.

8. The method of showering of claim 7, wherein the program is pre-programmed into the shower assembly's control unit microprocessor with the remote control.

9. The method of showering of claim 7, wherein the program is initiated with the remote control.

* * * * *